US009630820B2

(12) United States Patent
Beyer et al.

(10) Patent No.: US 9,630,820 B2
(45) Date of Patent: Apr. 25, 2017

(54) AUTOMATIC LIFT STAND AND CASE

(71) Applicants: Scott Beyer, San Francisco, CA (US); David Beyer, Fort Myers, FL (US)

(72) Inventors: Scott Beyer, San Francisco, CA (US); David Beyer, Fort Myers, FL (US)

( * ) Notice: Subject to any disclaimer, the term of this patent is extended or adjusted under 35 U.S.C. 154(b) by 0 days.

(21) Appl. No.: 14/287,163

(22) Filed: May 26, 2014

(65) Prior Publication Data

US 2015/0336780 A1 Nov. 26, 2015

(51) Int. Cl.

| | |
|---|---|
| ***B66F 7/08*** | (2006.01) |
| ***A45C 5/14*** | (2006.01) |
| ***A45C 7/00*** | (2006.01) |
| ***A45C 15/00*** | (2006.01) |

(52) U.S. Cl.

CPC ..... *B66F 7/08* (2013.01); *A45C 5/14* (2013.01); *A45C 7/0022* (2013.01); *A45C 15/00* (2013.01)

(58) Field of Classification Search

CPC A45C 15/00; A47F 3/00; A47B 51/00; A47B 37/02; B66F 2700/09; B66F 3/24; B66F 3/247; B66F 7/08; B66F 7/085; B66F 9/04

See application file for complete search history.

(56) References Cited

U.S. PATENT DOCUMENTS 1,859,401 A * 5/1932 Lengsfield ..... B65D 5/5213 206/751
2,201,948 A * 5/1940 Watkins ..... A47B 63/00 109/69
2,284,531 A * 5/1942 Miller ..... A47B 51/00 187/269
2,861,857 A * 11/1958 Lee ..... A47B 83/045 312/312
3,066,993 A * 12/1962 Mark ..... A47B 9/00 312/21
3,454,317 A * 7/1969 Salkind ..... A47B 37/02 312/21
4,065,194 A * 12/1977 Mattia ..... E04H 3/26 108/147
5,273,352 A * 12/1993 Saper ..... A47B 51/00 312/312
6,361,131 B1 * 3/2002 Powell, Jr. ..... A47B 46/00 187/254

(Continued)

*Primary Examiner* — Larry E Waggle, Jr.
*Assistant Examiner* — Tyrone V Hall, Jr.
(74) *Attorney, Agent, or Firm* — NWAMU, P.C.

(57) ABSTRACT

An automatic lift stand and case. The automatic lift stand and case includes a body having an opening and containing a platform. A latch mechanism is configured to maintain the platform in a lower position within the body. One or more resilient stored force devices are configured to move the platform from the lower position towards the opening of the body when the latch mechanism is released. One or more springs are pivotably coupled to the body and the platform, the length of each spring is substantially parallel to the platform when the platform is in the lower position and pivots to lift the platform as the platform is lifted towards the opening of the body by the one or more resilient stored force devices. Each spring is configured to lift the platform to a higher position when the resilient stored force devices pull the platform towards the opening of the body.

19 Claims, 5 Drawing Sheets

(56) References Cited

U.S. PATENT DOCUMENTS

| | | | | |
|---|---|---|---|---|
| 6,733,094 | B1 * | 5/2004 | Chang | A47B 21/0073 312/306 |
| 6,851,770 | B2 * | 2/2005 | Canedy | A47F 3/002 312/114 |
| 8,047,619 | B2 * | 11/2011 | Amstutz | A47F 3/002 312/117 |
| 2003/0010967 | A1 * | 1/2003 | Enochs | B66F 7/0666 254/266 |

* cited by examiner

AUTOMATIC LIFT STAND AND CASE

BACKGROUND OF THE INVENTION

This disclosure relates generally to the field of cases and stands. More particularly, the disclosure relates to automatic lift cases and stands.

Musicians typically carry audio amplifiers, speakers and other large, heavy equipment on the road with them as they travel to various venues to perform. Equipment is often put into a carrying case to protect the equipment while it is in transit or being stored.

At the destination, the equipment is manually lifted out the case and placed on a flat surface so that it can be used. After use, the equipment is manually lifted and placed back into the case for transit or storage. This repeated handling of large, heavy equipment can be burdensome.

It is within the aforementioned context that a need for the present invention has arisen. Thus, there is a need to address one or more of the foregoing disadvantages of conventional systems and methods, and the present invention meets this need.

BRIEF SUMMARY OF THE INVENTION

Various aspects of an automatic lift stand and case can be found in exemplary embodiments of the present invention.

In one embodiment, an automatic lift case automatically lifts an object such as an audio amplifier from a lower position on a platform within the case to a higher position when a lid is opened. The amplifier may be used in the higher position.

After use, the amplifier can be pushed down to a latched position for storage and the lid can cover the amplifier within the case. This cycle may be repeated without having to manually lift the amplifier out of the case. In this manner, an embodiment of the present invention provides automatic lifting of amplifiers and the like and can prevent debilitating back injury associated with manual lifting of heavy equipment.

A latch mechanism at the bottom of the case is coupled with a latch strike on the bottom of the platform in a lower position. One or more gas springs are pivotably coupled between the body and platform.

In one embodiment, the length of each spring is substantially parallel to the platform when the platform is in the lower position. A lid may be included to cover the opening. The case containing an object in the lower position may be transported or stored.

One or more resilient stored force devices, such as latex tubes, are extended as the platform is moved to the lower position and maintained in the lower position by the latch mechanism. The one or more resilient stored force devices move the platform from the lower position towards the opening of the body when the latch strike is released by the latch mechanism.

Each gas spring can pivot and lift the platform to the higher position in response to the resilient stored force devices pulling the platform towards the opening of the body. In this manner, an embodiment of the present invention provides a simple, yet safe and effective mechanism for lifting and retaining amplifiers in usable position without the need for electric motors or other complex machinery.

In some embodiments, the case may be configured to support other types of objects across a range of weights and dimensions. These objects may include objects for transport and storage like the audio amplifier or they may include more permanently placed objects like a television capable of being stored away in a living room case. The invention is not limited to work with any particular types of objects.

A further understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Figure 1:
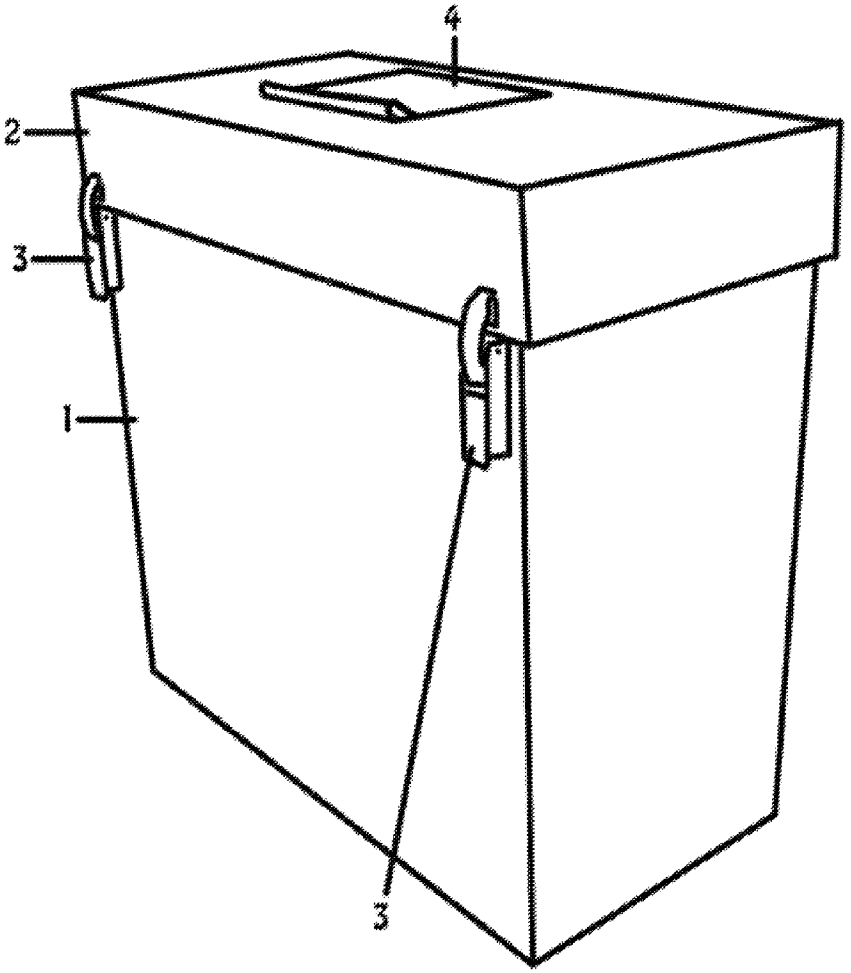
FIG. 1 shows an automatic lift case with a closed lid, according to one embodiment.

Reference will now be made in detail to the embodiments of the invention, examples of which are illustrated in the accompanying drawings. While the invention will be described in conjunction with the one or more embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

In one embodiment, an automatic lift case automatically lifts an audio amplifier from a lower position on a platform within the case to a higher position when a lid is opened. The amplifier may be used in the higher position.

After use, the amplifier can be pushed down and latched in the lower position and the lid can cover the amplifier in the lower position within the case for storage or transportation. This cycle may be repeated without having to manually lift the amplifier out of the case.

One or more gas springs are each pivotably connected on one end to a side of the case and pivotably coupled on the other end to the bottom of the platform. When the audio amplifier is in its lower position, the gas springs lie substantially parallel to the bottom of the platform.

Positioning the gas springs substantially parallel to the platform allows the springs to be compact when not in use thereby limiting any extra case volume required to include this automatic lifting apparatus. However, in a position substantially parallel to the platform, the gas springs do not create sufficient lift in the vertical direction to move the audio amplifier to the higher position.

In some embodiments, one or more pairs of gas springs are pivotably coupled to opposite sides of the case on one end and pivotably coupled to opposite sides of the bottom of the platform on the other end.

When the audio amplifier is moved into the case towards a lower position, the platform causes one or more resilient stored force devices, such as springs, latex tubes or bungees, to be extended until the platform is latched in the lower position. In some embodiments, these resilient stored force devices are distributed around the periphery of the platform to avoid obstructing the lateral space for the audio amplifier on the platform.

When the latches for all of the resilient stored force devices are released, the platform is pulled by the resilient stored force devices towards the higher position enough to cause the gas springs to pivot and extend until the gas springs are oriented in the vertical direction enough to lift the platform the rest of the way to the higher position.

Release cables are attached on one end at the lid and on the other end at the latch mechanisms latching the platform in the lower position. When the lid is opened the release cables cause the latch mechanisms to release the latch strikes.

In some embodiments, the latch mechanism and latch strike operates like a door knob latch. In other embodiments, the latch mechanism and latch strike operates like a car trunk latch. In yet other embodiments, the latch mechanism and latch strike operates like a gate latch.

In an embodiment, the automatic lift case lifts an audio amplifier weighing about 15-30 pounds. Four three-eighth inch inner diameter Amber latex springs are used as the resilient stored force devices. Four gas springs are used, each having a force of about 80 pounds with partial damping on the extension.

In some embodiments, the case may be configured to support other types of objects across a range of weights and dimensions. These objects may include objects for transport and storage like the musician's audio amplifier or they may include more permanently placed objects like a television capable of being stored away in a living room case. The invention is not limited to work with any particular types of objects.

The length, number, force and distribution of the resilient stored force devices is selected to be sufficient to pull the anticipated load on the platform up enough to enable the gas springs to carry the loaded platform to the higher position.

The length, number, force, and distribution of the gas springs are selected to be able to lift the anticipated load on the platform to the higher position. In some embodiments, damped springs may be used to slow the extension and/or compression of the springs through all or part of the extension and/or compression.

This can be advantageous when the load on the platform may be sensitive to acceleration or deceleration. High acceleration or deceleration may cause undesired movement, loosened components, stress cracks, unnecessary wear and tear, and other damage to sensitive electronic equipment or other objects resting on the platform. In other embodiments, undamped springs and bungees may be used. In some embodiments, extension, compression or torsion springs may be used.

FIG. 1 shows one embodiment of an automatic lift case.

In FIG. 1, a body 1 is configured to have the size and shape to contain an audio amplifier. In some embodiments, the body 1 is an enclosed container. In other embodiments, the body is an open frame. In some embodiments, the case is designed for easy transport.

A lid 2 is configured to cover an opening in the body 1 to enclose the audio amplifier (not shown) within the body 1. Latches 3 are used to secure the lid 2 in a closed position. A handle portal 4 is a covered opening in the lid 2 that allows a person to reach through to grasp a handle on the audio amplifier enclosed within the body 1.

Figure 2:
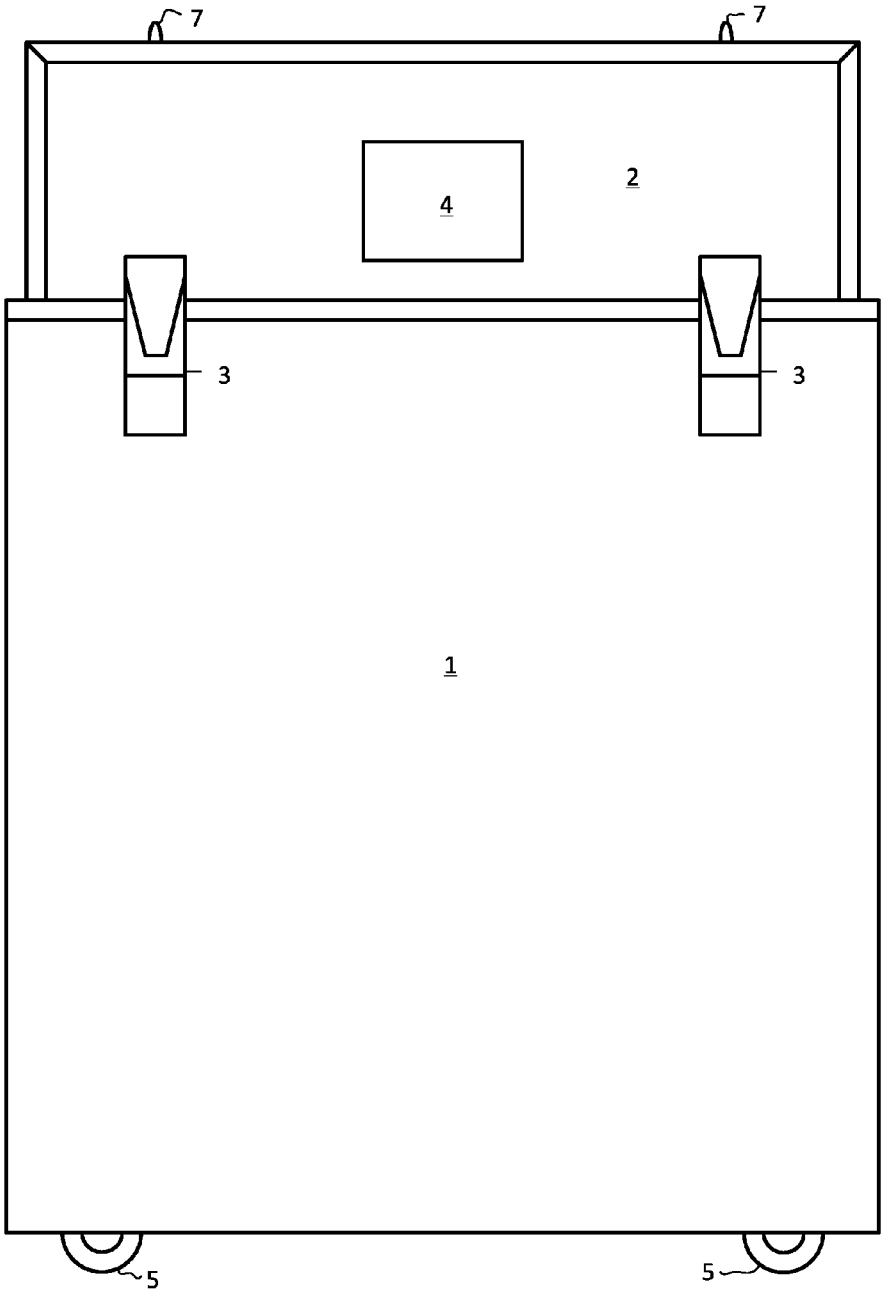
FIG. 2 is a diagram of an automatic lift case with an open lid, according to one embodiment.

FIG. 2 is a diagram of an embodiment of an automatic lift case with an open lid.

In FIG. 2, the body 1 rests on wheels 5 to allow for rolling transport. The latches 3 are positioned to latch the latch catches 7 when the lid 2 is in the closed position.

Figure 3:
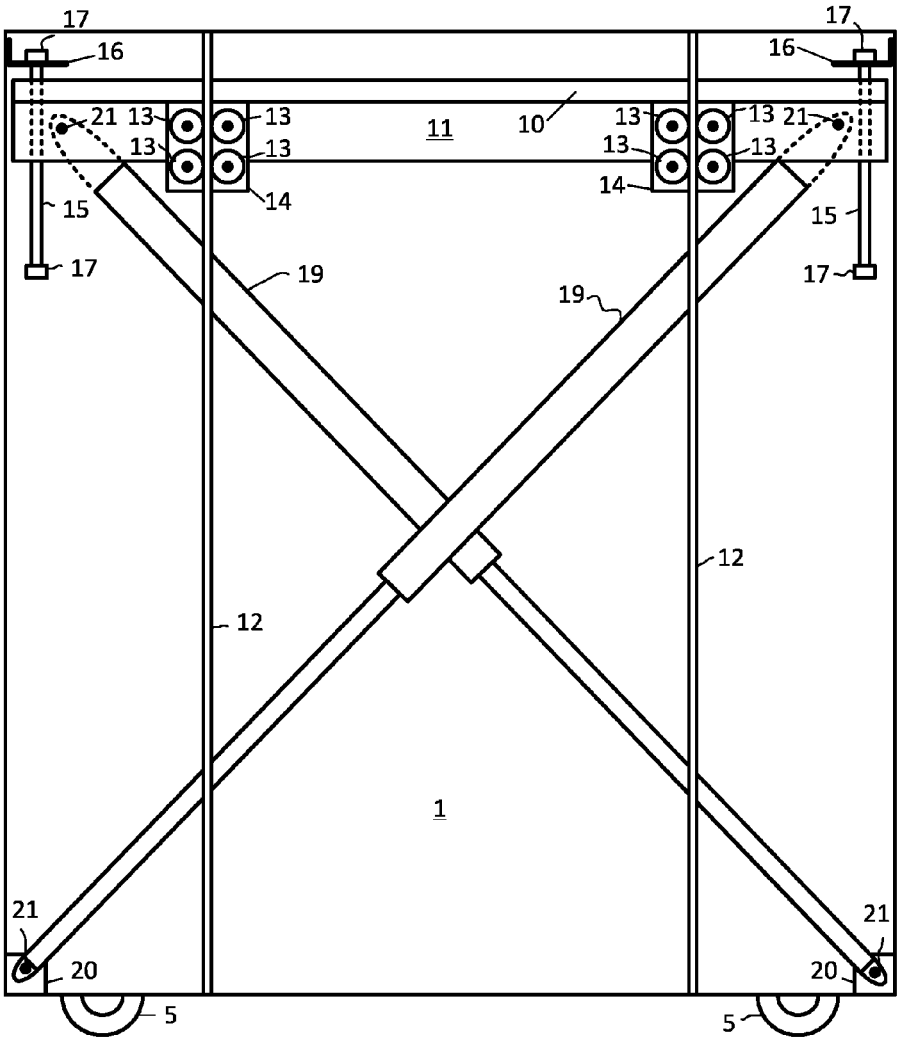
FIG. 3 is a diagram of an internal view of an automatic lift case with the platform in a higher position, according to one embodiment.

FIG. 3 is a diagram of an embodiment of an automatic lift case with a view behind the front wall of the body 1 when the platform 10 is at the higher position.

In FIG. 3, the audio amplifier is not shown. In some embodiments, the platform has a short vertical wall around the periphery to mount the audio amplifier to the platform or to prevent objects from sliding around the edge and into the cavity below.

In other embodiments the audio amplifier may be strapped onto the platform. The body 1 rests on wheels 5 to allow for easy transport. Each gas spring 19 is connected by a connector bolt 21 to a connector bracket 20 on opposite sides at the base of the body 1.

The other end of each gas spring 19 is connected by a connector bolt 21 to a corresponding connector bar 11 mounted on the front and back of the bottom of the platform 10. The gas springs pivot on the connector bolts and extend or compress as the platform 10 moves between a lower position near the bottom of the body 1 and the higher position above the lower position.

One or more carriage tracks 12 may be mounted on the sides of the body 1 to guide the platform 10 as it moves between the lower position and the higher position. Carriage brackets 14 are mounted to the platform 10. The carriage brackets 14 have carriage wheels 13 configured to ride along the carriage tracks 12 as the platform 10 moves between the lower position and the higher position.

The higher position is determined by the length and the pivot positions of the gas springs when extended. In one embodiment, the higher position may be midway between the lower position and the opening of the body 1. In another embodiment, the higher position may be such that the top of the platform is flush with the opening of the body 1.

In yet another embodiment, the higher position may be such that the top of the platform is slightly below the opening of the body 1 to prevent lateral movement of the audio amplifier on the platform. In still another embodiment, the higher position may be such that the platform extends above the opening of the body 1.

A terminal 17 at the top end of each of the resilient stored force devices 15 is coupled to the body 1 by a corresponding bracket 16 above the platform 10. When the platform is in the higher position, the resilient stored force devices 15 hang in a vertical direction at roughly their natural length.

As the platform 10 is lowered, it catches a terminal 17 at the bottom end of each of the resilient stored force devices 15 thereby extending the resilient stored force devices 15 as the platform 10 continues to be lowered. Eventually the platform is latched in the lower position holding the resilient stored force devices 15 in an extended disposition. The platform latches are not shown in this figure but are described in more detail with respect to FIG. 6.

Figure 4:
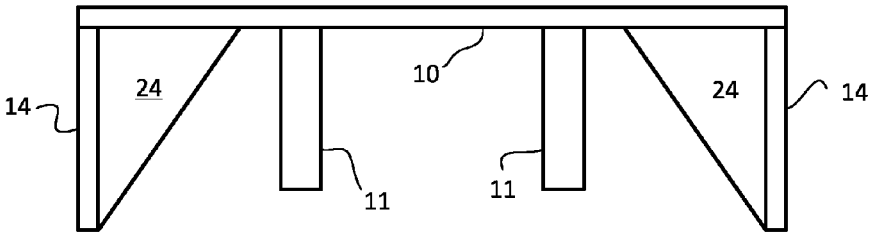
FIG. 4 is a cross sectional diagram of the platform showing a stabilizer device, according to one embodiment.

FIG. 4 is a diagram of a cross section portion of the platform 10, connector bars 11 and stabilizers 24 in a plane corresponding to the position of carriage brackets 14.

In FIG. 4, the front connector bar 11 is used to connect a pair of the gas springs 19 (not shown). The back connector bar 11 is used to connect another pair of the gas springs 19 (not shown). Each stabilizer 24 is used to prevent the platform 10 from wobbling as the platform moves up and down the carriage tracks 12.

If the platform 10 wobbles it may cause the carriage brackets 12 to lockup on the carriage tracks 12. In some embodiments multiple stabilizers 24 are used to stabilize the platform 10 around each of the carriage tracks 12 to prevent the platform 10 from wobbling. In other embodiments, additional connector bars 11 may be mounted between the front and back connector bars to mount additional gas springs.

Figure 5:
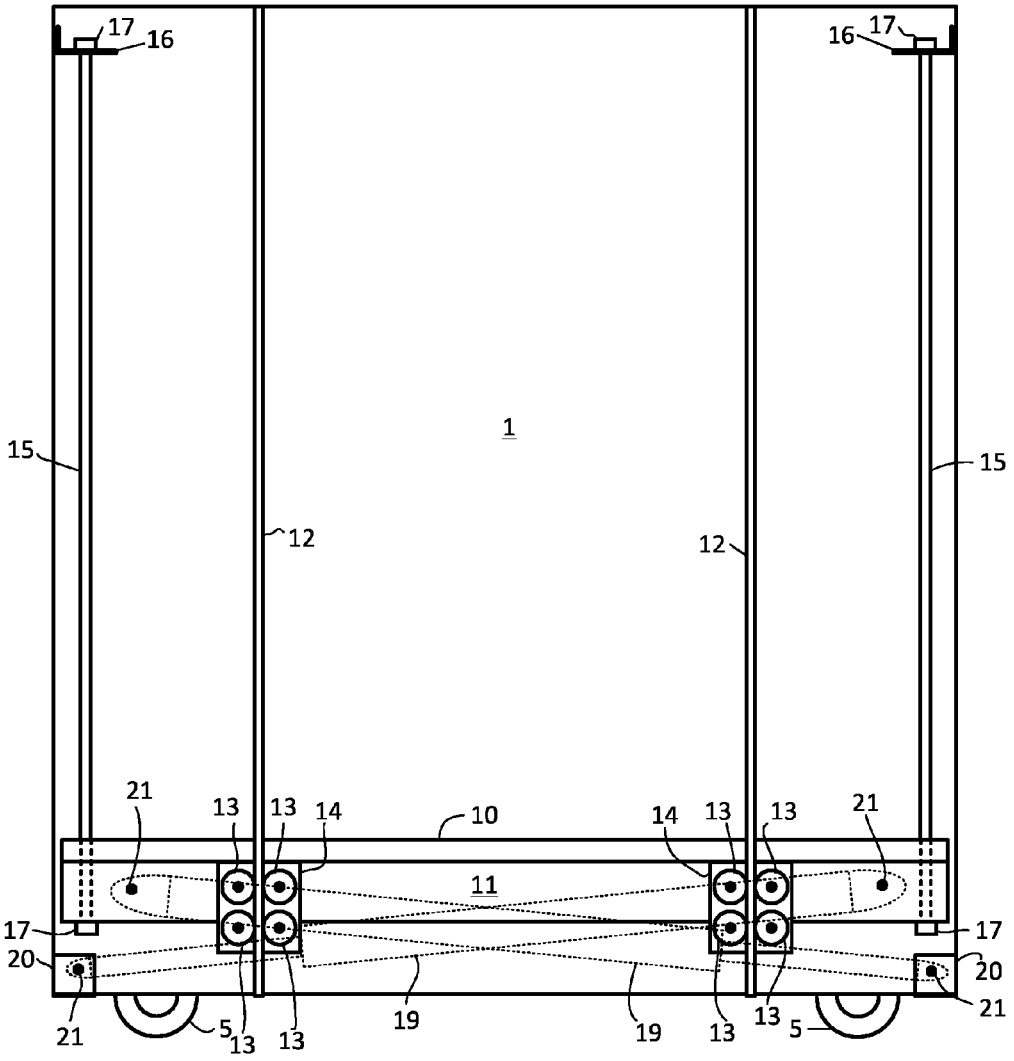
FIG. 5 is a diagram of an internal view of an automatic lift case with the platform in a lower position, according to one embodiment.

FIG. 5 is a diagram of an automatic lift case with a view behind the front wall of the body 1 when the platform 10 is at the lower position.

In FIG. 5, the lid and audio amplifier is not shown. The body 1 rests on wheels 5 to allow for easy transport. Each gas spring 19 is connected by a connector bolt 21 to a connector bracket 20 on opposite sides at the base of the body 1.

The other end of each gas spring 19 is connected by a connector bolt 21 to a corresponding connector bar 11 mounted on the bottom of the platform 10. The gas springs pivot on the connector bolts and extend or compress as the platform 10 moves between a lower position near the bottom of the body 1 and the higher position above the lower position.

A pair of gas springs are shown here, but similar pairs of gas springs may be connected to additional connector bars 11 to increase the lift. In some embodiments an odd number of gas springs are used.

One or more carriage tracks 12 may be mounted on the sides of the body 1 to guide the platform 10 as it moves between the lower position and the higher position. Carriage brackets 14 are mounted to the platform 10 via the stabilizers 24.

The carriage brackets 14 have carriage wheels 13 configured to ride along the carriage tracks 12 as the platform 10 moves between the lower position and the higher position. The lower position is determined by the location of the latch mechanism described in more detail with respect to FIG. 6.

In one embodiment, the lower position may be near the bottom of the body 1, allowing just enough room between the bottom of the platform 10 and the bottom of the body 1 for the gas springs to lay substantially parallel to the bottom of the platform 10. In another embodiment, the lower position may be higher, allowing more room between the platform 10 and the bottom of the body 1.

In a one embodiment, the length of each gas spring 19 is substantially parallel to the platform 10 when in the lower position. One skilled in the art will recognize that when the platform 10 is in the lower position, a range of gas spring orientation relative to the platform outside of perfectly parallel is consistent with the spirit and scope of the present invention.

In some embodiments, the angle between the platform and the gas springs may be in the range from 0 to 30 degrees when in the lower position. It will be apparent to one skilled in the art that a range of orientation of the gas springs relative to the platform in the lower position benefits by the use of the resilient stored force devices as described herein to move the gas springs into position so that the gas springs can lift the platform to the higher position.

A terminal 17 at the top end of each of the resilient stored force devices 15 is coupled to the body 1 by a corresponding bracket 16 above the platform 10. When the platform is in the higher position, the resilient stored force devices 15 hang in a vertical direction at roughly their natural length.

As the platform 10 is lowered, the platform 10 catches a terminal 17 at the bottom end of each of the resilient stored force devices 15 thereby extending the resilient stored force devices 15 as the platform 10 is lowered.

Eventually the platform 10 is latched at the lower position by the latch mechanism maintaining the resilient stored force devices 15 in an extended disposition. The platform latch mechanism is not shown in this figure but one embodiment is diagrammed separately in FIG. 6.

Figure 6:
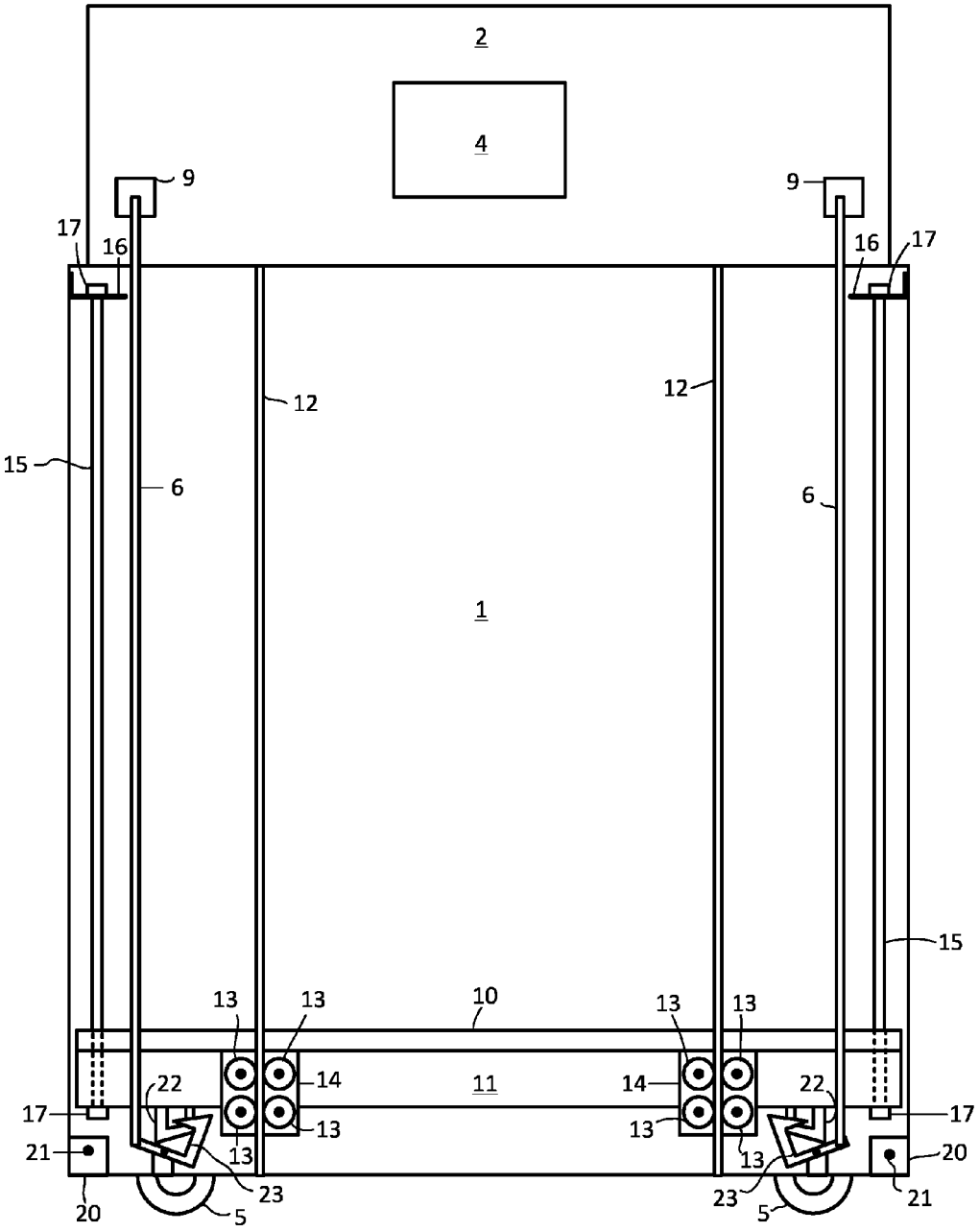
FIG. 6 is a diagram of an internal view of an automatic lift case showing the latch mechanism with the platform a lower position, according to one embodiment.

FIG. 6 is a diagram of an automatic lift case according to one embodiment.

In FIG. 6, the gas springs are not shown in this figure. In some embodiments, this latch release mechanism is used in combination with the embodiments shown in the other figures.

Latch strikes 22 are coupled to the bottom of the platform 10. Platform latches 23 are mounted to the bottom of the body 1.

When the platform 10 is pushed down to the lower position the platform latches 23 catch the corresponding latch strike 22 to hold the platform in the lower position even though the resilient stored force devices 15 are pulling upwards on the platform 10. Pull cables 6 are coupled on one end to brackets 9 on the bottom of the lid 2.

When the lid 2 is opened, the release cables 6 are pulled up by the brackets 9 and tilt the corresponding latches 23 thereby releasing the corresponding latch strikes 22. FIG. 6 shows the latch mechanisms 23 tilted but not tilted enough to release the latch strikes 22. When the latch strikes 22 are released, the platform 10 is pulled up by the resilient stored force devices 15 and then the platform 10 is lifted further by the gas springs (not shown).

Alternative latch mechanisms and latch strikes may be used to hold the platform 10 in the lower position. A handle portal 4 is a covered opening in the lid 2 that allows a person to reach through to grasp a handle on the audio amplifier or other device enclosed within the body 1.

While the above is a complete description of exemplary specific embodiments of the invention, additional embodiments are also possible. Thus, the above description should not be taken as limiting the scope of the invention, which is defined by the appended claims along with their full scope of equivalents.

We claim:

1. An automatic lift case comprising: a body having an opening;

a platform movable between a lower position within the body and a higher position towards the opening of the body, the platform being releasably coupled to the body in the lower position;

at least one stored force device having a natural length between its first end and a second end, the first end of the stored force device being coupled to the body and the second end of the stored force device being coupled to the platform, the at least one stored force device retaining its natural length when the platform is in the higher position and being extended beyond its natural length when the platform is in the lower position, wherein the at least one stored force device comprises a terminal on the second end, wherein the platform engages the terminal to extend the stored force device as the platform is moved toward the lower position and the platform disengages the terminal as the platform is moved towards the higher position, the platform otherwise not being coupled to the stored force device; and at least one spring each having a first end pivotably coupled to the body and a second end pivotably coupled to the platform wherein the at least one spring is pivotable and is extendable to lift the platform to the higher position when the platform is released from the body in the lower position.

2. The automatic lift case of claim 1 further comprising:

a latch strike coupled to the bottom of the platform; and a latch mechanism coupled to the body, the latch mechanism being releasably coupled to the latch strike of the platform in the lower position.

3. The automatic lift case of claim 1 wherein the length of each at least one spring is substantially parallel to the platform when the platform is in the lower position.

4. The automatic lift case of claim 1 wherein the at least one spring comprises a damped spring.

5. The automatic lift case of claim 1 wherein the at least one spring comprises a gas spring.

6. The automatic lift case of claim 1 wherein the at least one stored force device comprises a spring.

7. The automatic lift case of claim 1 wherein the at least one stored force device comprises a latex tube.

8. The automatic lift case of claim 1 wherein the at least one stored force device comprises a bungee.

9. The automatic lift case of claim 1 wherein a carriage track is coupled to the body, the platform being coupled to a bracket having wheels configured to ride along the carriage track as the platform moves between the lower position and the higher position.

10. The automatic lift case of claim 1 further comprising a lid coupled to the body, the lid being configured to cover the opening in a closed position, the lid having an opening to allow a user to grasp a handle of an object on the platform when the lid is in the closed position.

11. An automatic lift case comprising: a body having an opening;

a platform movable between a lower position within the body and a higher position towards the opening of the body, the platform being releasably coupled to the body in the lower position;

at least one stored force device having a natural length between its first end and a second end, the first end of the stored force device being coupled to the body and the second end of the stored force device being coupled to the platform, the at least one stored force device retaining its natural length when the platform is in the higher position and being extended beyond its natural length when the platform is in the lower position;

at least one spring each having a first end pivotably coupled to the body and a second end pivotably coupled to the platform wherein the at least one spring is pivotable and is extendable to lift the platform to the higher position when the platform is released from the body in the lower position;

a lid coupled to the body, the lid being configured to cover the opening in a closed position;

a latch strike coupled to the bottom of the platform;

a pull latch coupled to the latch strike of the platform in the lower position; and a release cable having a first end coupled to the lid and a second end coupled to the pull latch, the release cable automatically releasing the pull latch from the latch strike when the lid is opened.

12. The automatic lift case of claim 11, wherein the length of each at least one spring is substantially parallel to the platform when the platform is in the lower position.

13. The automatic lift case of claim 11, wherein the at least one spring comprises a damped spring.

14. The automatic lift case of claim 11, wherein the at least one spring comprises a gas spring.

15. The automatic lift case of claim 11, wherein each at least one stored force device comprises a terminal on the second end, wherein the platform engages the terminal to extend the stored force device as the platform is moved toward the lower position and the platform disengages the terminal as the platform is moved towards the higher position, the platform otherwise not being coupled to the stored force device.

16. The automatic lift case of claim 11, wherein the at least one stored force device comprises a spring.

17. The automatic lift case of claim 11, wherein the at least one stored force device comprises a latex tube.

18. The automatic lift case of claim 11, wherein the at least one stored force device comprises a bungee.

19. The automatic lift case of claim 11, wherein a carriage track is coupled to the body, the platform being coupled to a bracket having wheels configured to ride along the carriage track as the platform moves between the lower position and the higher position.

* * * * *